United States Patent [19]

Vogel

[11] 4,243,097

[45] Jan. 6, 1981

[54] WASTE HEAT BOILER

[75] Inventor: Jacobus E. Vogel, The Hague, Netherlands

[73] Assignee: Shell Oil Company, Houston, Tex.

[21] Appl. No.: 902,478

[22] Filed: May 3, 1978

Related U.S. Application Data

[63] Continuation of Ser. No. 717,801, Aug. 26, 1976, abandoned.

[30] Foreign Application Priority Data

Aug. 27, 1975 [GB] United Kingdom ..... 35350/75

[51] Int. Cl.[2] ..... F28D 7/10

[52] U.S. Cl. ..... 165/163

[58] Field of Search ..... 165/163, 159–161; 122/7 R

[56] References Cited

U.S. PATENT DOCUMENTS

| | | | |
|---|---|---|---|
| 2,160,898 | 6/1939 | Peff | 165/163 |
| 2,967,515 | 1/1961 | Hofstede et al. | 122/7 R |
| 3,482,625 | 12/1969 | Bray | 165/160 |
| 3,662,717 | 5/1972 | Haar | 122/7 R |
| 3,903,964 | 9/1975 | Dourn | 165/158 |

*Primary Examiner*—Samuel Scott
*Assistant Examiner*—Theophil W. Streule, Jr.

[57] ABSTRACT

Heat exchange apparatus characterized by recirculation channels for the exchange fluid is disclosed.

8 Claims, 2 Drawing Figures

WASTE HEAT BOILER

This is a continuation of application Ser. No. 717,801, filed Aug. 26, 1976, now abandoned.

BACKGROUND OF THE INVENTION

This invention relates to heat exchange apparatus. More particularly, the invention relates to heat exchange apparatus suitable for removing or abstracting heat from gases which have very high temperatures and pressures and/or contain suspended matter which is subject to deposition in heat-exchanger tubes through which the gases flow. In its preferred form, the apparatus of the invention is particularly suited for generating steam under pressure from the sensible heat in the reaction gas from a plant for the preparation of hydrogen and carbon monoxide by the partial combustion of a hydrocarbon with oxygen, at superatmospheric pressure, optionally with the supply of steam.

Gases produced in many processes, such as partial combustion processes, generally are discharged from their source at temperatures of from 1000° C. to 1500° C. and are, therefore, a potential source of energy. Because of the fact that many such gases contain suspended matter, such as free carbon, heat exchange units of special design are utilized to recover the thermal energy available at the high temperatures. In general, the great temperature differences and high pressures prevailing in such heat exchangers require the apparatus to be of special quality and strength. Heat exchangers comprising helically wound gas cooling pipes are particularly suitable in fulfilling the mechanical requirements. Suitable heat exchangers operating as waste heat boilers for the purpose mentioned above have been described e.g. in British Pat. Spec. Nos. 851,542, 1,332,809 and 1,340,254.

Accordingly, it is an object of the invention to provide a heat exchange apparatus suitable for cooling such high-temperature gases wherein the cooling tubes or pipes through which the hot gases flow are intensively cooled at the entrance point, whereby mechanical difficulties are mitigated, and which apparatus is particularly suitable for operation at high capacities and pressures.

SUMMARY OF THE INVENTION

In brief, the invention relates to heat exchange apparatus comprising an upright shell, preferably cylindrical, including a top and bottom closure, an upright liquid tube disposed within the shell in radially spaced relation to the shell and defining therewith a vertically elongated annular cooling space, a plurality of concentrically arranged helically wound cooling pipe sections surrounding the liquid tube and having gas inlets for the high temperature gas near the bottom of the shell, a supply inlet or inlets for coolant arranged in the vicinity of the gas inlets at the bottom part of the shell, the helically wound gas cooling pipe sections at their upper ends being transformed into substantially straight pipe members arranged between the helical pipe sections and the liquid tube, which pipe members extend to and are connected near the bottom of the shell with gas oulets, and a plurality of coolant recirculation channels located, respectively, in the spaces between the helical pipe sections, the pipe members or units and the upright liquid tube. The channels are open at both ends and preferably are formed by the outer wall of the liquid tube and wall parts extending from the upright liquid tube.

Preferably the pipe members are arranged symmetrically with respect to the shell axis, and are further arranged in pairs. The coolant recirculation channels are then preferably arranged between the pairs of pipe members.

The number of (pairs of) pipe members and the number of recirculation channels may vary, but preferably will be at least two and at most six.

Each recirculation channel is preferably formed of a part of the wall of the liquid tube from which two longitudinal projections forming lateral wall parts extend outwardly, each projection being adjacent to a pipe unit or a (pair of) pipe units, the two projections at their outward ends being connected by a slightly curved surface or baffle and thus forming the exterior wall of the channel. The projections and curved surface combination may be of integral construction.

According to the invention, the pipes may be suspended in braces connected by rods to a yoke, the assembly being capable of compensating thermal stresses.

The recirculation channels preferably extend from below the yoke but above the upper level of the gas cooling pipes toward the bottom end of the liquid tube, preferably to the bottom end of the liquid tube, above the coolant supply inlet or inlets.

DETAILED DESCRIPTION OF THE INVENTION

Figure 1:
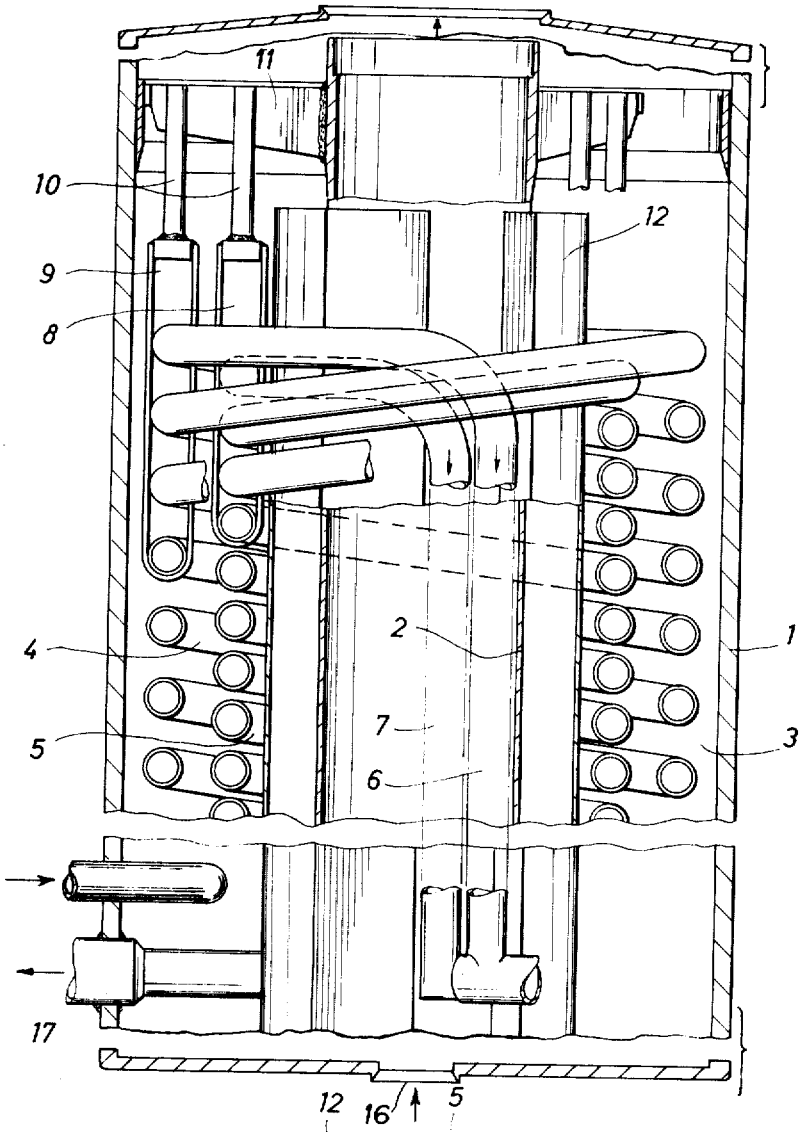

The invention will now further be illustrated with reference to the accompanying drawing. The drawing illustrates, partly schematically, a preferred embodiment of a heat recovery apparatus according to the invention.

Figure 2:
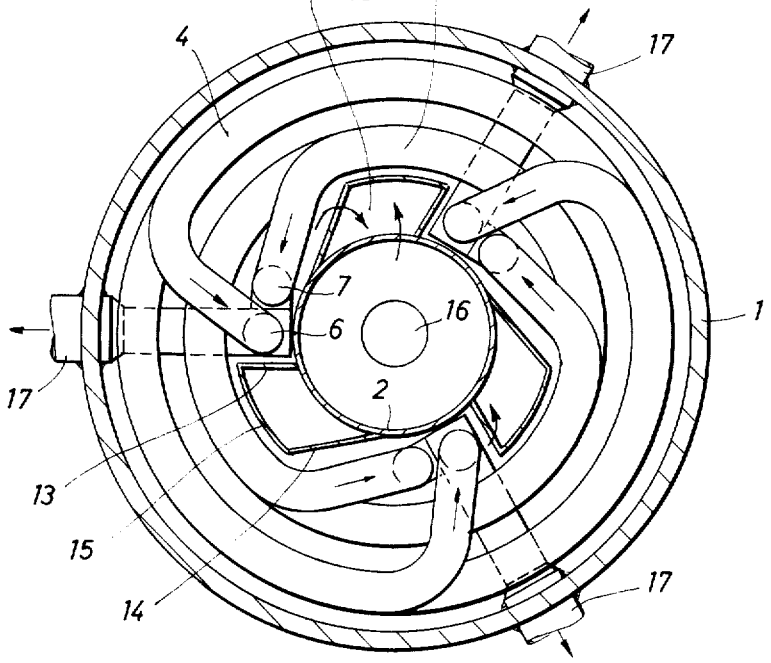

FIG. 1 is a part of a vertical section of the upper part of the apparatus of the invention, and FIG. 2 is a cross section seen from above (along the line 2—2 of FIG. 1).

In the embodiment shown, the heat exchange apparatus contains three pairs of straight pipe members and three recirculation channels therebetween. In the figures, (1) designates the outer shell of the heat exchange unit, and the liquid tube is indicated by (2). Between the shell (1) and the tube (2) annular cooling space (3) is present. Within this cooling space a plurality of helically wound gas cooling pipe sections are arranged, indicated by lines (4) and (5) respectively, wherein the helix of pipe or pipes (4) has a larger radius than the pipe or pipes (5), pipe(s) (4) being arranged closer to the wall of shell (1).

The gas flow paths in each of the pipes (4) and (5) are substantially identical in length, so as to promote even distrubution of the gas over the pipes (equal pressure drop $\Delta p$). Between the helical pipe coils (4) and (5) and the tube (2), substantially straight gas pipe members or units, indicated by lines (6) and (7), are present and at the top connected with and in communication with the helical pipe sections. The pipes are suspended in braces (8) and (9) respectively, and braces (8) and (9) are connected by rods (10) to a yoke (11). The assembly is capable of compensating thermal expansion stresses, such a provision being required so as to receive mainly longitudinal expansion of the pipe members when the boiler is put into operation. Only one pair of pipe members has been indicated in FIG. 1. Recirculation channels (12) are arranged between the gas cooling pipes and the liquid tube, and the configuration of these channels is more clearly shown in FIG. 2.

In FIG. 2, the same reference numerals have been used for identical parts referred to in FIG. 1.

The recirculation channels (12) utilize as much as feasible of the space (3) not occupied by gas cooling pipes. The channels (12) are formed by flat projections or baffles (13) and (14) each extending from the wall of tube 2 and preferably welded thereto, while the most exterior wall part of the channel is formed with slightly curved baffle (15) which in turn is welded to baffles (13) and (14).

If the apparatus of the invention is operated as a steam raising unit, the hot gases are normally cooled by water. During operation, the water within the annular cooling space (3) is heated by the hot gas in the pipes very rapidly and soon reaches its boiling point. A part of the liquid is collected directly in the recirculation channels (12) by overflow or splashing into the open upper end thereof; another part of the water is entrained with the raised steam and evacuated through the top of the boiler to a steam/water separation drum or the like (not shown) from which the separated water is recirculated through liquid tube 2 which is in liquid receiving communication with the separation drum at its upper part (not shown). The channels (12) thus receive directly a part of the recirculation water and consequently operate as downcomers.

Fresh cooling water is supplied through water pipe (16) within liquid tube (2) and is introduced near the bottom of the shell where the gases still have their highest temperature.

Cooled gas is removed through gas outlets (17) which are in communication with the pairs of pipe members (6) and (7). These pairs of pipe members can merge just before their connection with gas outlets (17).

Those skilled in the art will recognize that the invention is not limited to the specific embodiment described, and that the invention also can be used in combination with other heat recovery designs.

What we claim is:

1. Heat exchange apparatus for high temperature gases comprising an upright shell including a top and bottom closure, an upright liquid tube disposed within the shell in radially spaced relation to the shell and defining therewith a vertically elongated annular cooling space, a plurality of concentrically arranged helically wound cooling pipe sections surrounding the liquid tube and disposed in the annular cooling space for a high temperature gas, the cooling pipe sections having gas inlet means communicating therewith disposed near the bottom of the shell, means for supplying coolant disposed near the bottom of the shell, said helically wound gas cooling pipe sections at their upper ends being transformed into substantially straight pipe members disposed between the helical pipe sections and the liquid tube, which pipe members extend to and are connected near the bottom of the shell with gas outlet means, and means defining a plurality of coolant recirculation channels located, respectively, in the spaces between said helical pipe sections, said pipe members and said upright liquid tube.

2. The apparatus of claim 1 wherein said pipe members are symmetrically arranged with respect to the shell axis.

3. The heat exchange apparatus of claim 1, wherein said pipe members are arranged in pairs and the coolant recirculation channels are arranged between said pairs of pipe members.

4. The apparatus of claim 1 wherein the coolant recirculation channels are open at both ends and formed by the outer wall of said upright liquid tube and wall parts extending from said upright liquid tube.

5. The apparatus of claim 4 wherein the recirculation channels extend from below the upper end of the liquid tube but above the upper level of the gas cooling pipes toward the bottom end of the liquid tube to a point above where the means for supplying coolant are located.

6. The apparatus of claim 5 wherein each of said helical pipe sections is substantially identical in length.

7. The apparatus of claim 6 wherein said pipe members are symmetrically arranged with respect to the shell axis.

8. The heat exchange apparatus of claim 6, wherein said pipe members are arranged in pairs and the coolant recirculation channels are arranged between the pairs of pipe members.

* * * * *